US007109430B2

(12) United States Patent
Horton et al.

(10) Patent No.: US 7,109,430 B2
(45) Date of Patent: Sep. 19, 2006

(54) LOW PROFILE ROTARY SWITCH WITH DETENT IN THE BUSHING

(75) Inventors: Donald Horton, Canoga Park, CA (US); William Miller, Fullerton, CA (US)

(73) Assignee: Emrise Corporation, Rancho Cucanonga, CA (US)

( * ) Notice: Subject to any disclaimer, the term of this patent is extended or adjusted under 35 U.S.C. 154(b) by 0 days.

(21) Appl. No.: 10/522,700

(22) PCT Filed: Jul. 17, 2003

(86) PCT No.: PCT/US03/22523

§ 371 (c)(1),
(2), (4) Date: Jan. 27, 2005

(87) PCT Pub. No.: WO2004/044938

PCT Pub. Date: May 27, 2004

(65) Prior Publication Data

US 2005/0258022 A1 Nov. 24, 2005

(51) Int. Cl.
*H01H 19/02* (2006.01)

(52) U.S. Cl. ..... 200/296; 200/336

(58) Field of Classification Search ..... 200/564, 200/565, 567, 296, 336, 570, 571, 11 R, 11 D, 200/11 DA See application file for complete search history.

(56) References Cited

U.S. PATENT DOCUMENTS

| | | | | | |
|---|---|---|---|---|---|
| 3,736,390 | A * | 5/1973 | Lockard | 200/11 DA |
| 3,986,410 | A * | 10/1976 | Robinson | 74/527 |
| 4,000,382 | A * | 12/1976 | Kolb | 200/4 |
| 4,454,391 | A | 6/1984 | Olsson | |
| 4,481,386 | A * | 11/1984 | Rose | 200/11 R |
| 4,891,476 | A * | 1/1990 | Nation et al. | 200/11 R |
| 5,606,155 | A * | 2/1997 | Garcia | 200/11 R |
| 5,811,745 | A * | 9/1998 | Hung | 200/11 R |
| 5,959,267 | A * | 9/1999 | Kawasaki et al. | 200/4 |
| 6,043,855 | A | 3/2000 | Grave | |
| 6,312,288 | B1 | 11/2001 | Genz et al. | |
| 6,541,723 | B1 * | 4/2003 | Rao et al. | 200/336 |

* cited by examiner

*Primary Examiner*—Michael A. Friedhofer
(74) *Attorney, Agent, or Firm*—Rutan & Tucker, LLP

(57) ABSTRACT

A panel mounted low profile rotary switch (100) contains a detent mechanism (120) mounted in a bushing (110). In a preferred class of embodiments, the detent sub-assembly comprises a single spring (220) positioned in parallel within the vertical extending shaft (130). The force exerted by the spring is manually adjusted by a set screw (210) to provide the desired downward applied vertical force on a plunger (230). The plunger, preferably a pointed cylinder, applies pressure to detent balls (240) causing the detent balls to move radially outward and engage rotor cams located on the inner surface of the detent mechanism.

14 Claims, 4 Drawing Sheets

FIG. 4
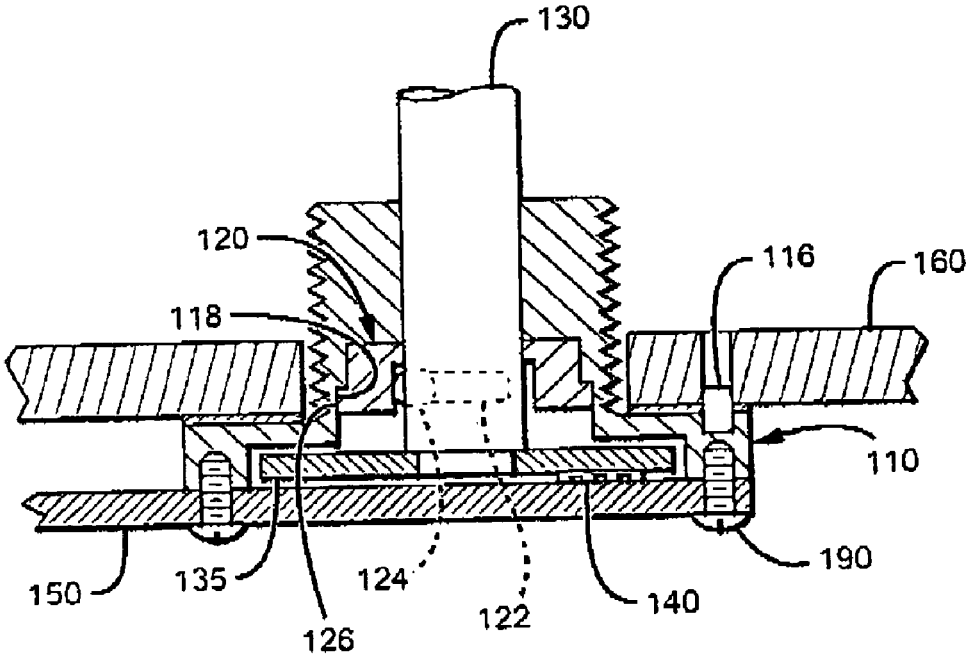
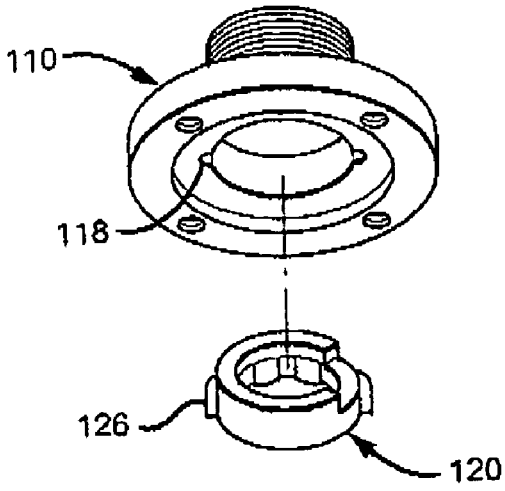
FIG. 5

LOW PROFILE ROTARY SWITCH WITH DETENT IN THE BUSHING

This application claims priority to PCT patent application number PCT/US02/35610 filed on 5 Nov. 2002.

FIELD OF THE INVENTION

The field of the invention is electromechanical rotary switches.

BACKGROUND OF THE INVENTION

A rotary electromechanical switch is generally defined as a device that has a rotating shaft connected to one terminal capable of making or breaking a connection to one or more other terminals. A rotary electromechanical encoder includes the overall characteristics of a rotary switch, but has additional mechanical movements. In any case, a user typically manipulates the switch to manually select a circuit.

Rotary switches and encoders are often mounted upon panels and other supporting structures in order that a user may control an electrical device. It is common for a portion of the switch to be on one side of the panel (the user side) and another portion of the switch to be on the other side of the panel (the inside). In many instances, the only portion of a switch that is on the user's side of the panel is a section of the shaft and a knob or other actuating means. Generally, the bulk of the switch is on the inside of the panel. For many years this type of configuration was sufficient, but over time the size of electrical devices has become increasingly smaller and there has become a need to reduce the size of the switch—especially that portion on the inside of the panel.

In order to meet the needs of smaller devices having less room under the panel, the size of the components of the switches have also become smaller. Yet, because these switches are comprised in part of mechanical components, there remained a practical limit as to how small they could become while still remaining useful. There became a need for different designs rather than just a reduction in the size of the components. One such design is taught in U.S. Pat. No. 4,454,391 to Olsson (June 1984). Olsson describes a low profile dip switch used on an integrated circuit board in which the actuating member of the dip switch is set within the body of the switch. By reducing the vertical profile of the switch, a lower overall footprint may be achieved for a board. The switch design taught by Olsson, however, does not address design problems related to panel mounted switches. Another patent which addresses problems in the design of switches is described in U.S. Pat. No. 6,312,288 to Genz et al. (November 2001). Genz teaches a low profile combination switch and connector assembly. While the switch described by Genz may have resulted in a lower overall profile of the combined components, this switch still does not address problems of panel mounted switches, specifically those problems due to limited space under the panel.

U.S. Pat. No. 6,043,855 to Grave (March 2000) is directed toward switches that mount on a bezel surrounding an LCD which is located on an avionics panel in an aircraft. The '855 patent teaches a design in which the detent is at least partially positioned in the knob of the switch. Still, the design of the '855 patent has its shortcomings: the detent is housed by the knob such that if the knob were to be displaced, the switch would not function or would function improperly; the detent is not entirely within the knob; the design requires two springs; and the springs are mounted vertically adding to the overall vertical profile of the knob.

As electronic devices become even smaller, there is a need for more compact and efficient designs.

SUMMARY OF THE INVENTION

The inventive subject matter is a panel mounted low profile switch having a detent sub-assembly housed in a bushing. The portion of the bushing housing the spring is in substantial planar relation with the panel within which the switch is mounted.

In some embodiments the detent sub-assembly comprises a single spring positioned vertically in the vertical extending shaft.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWING

FIG. 4 is a vertical cross-section of a portion of the switch of FIG. 1.

FIG. 5 is an exploded view of a bushing and detent mechanism in the switch of FIG. 1.

DETAILED DESCRIPTION

Figure 1:
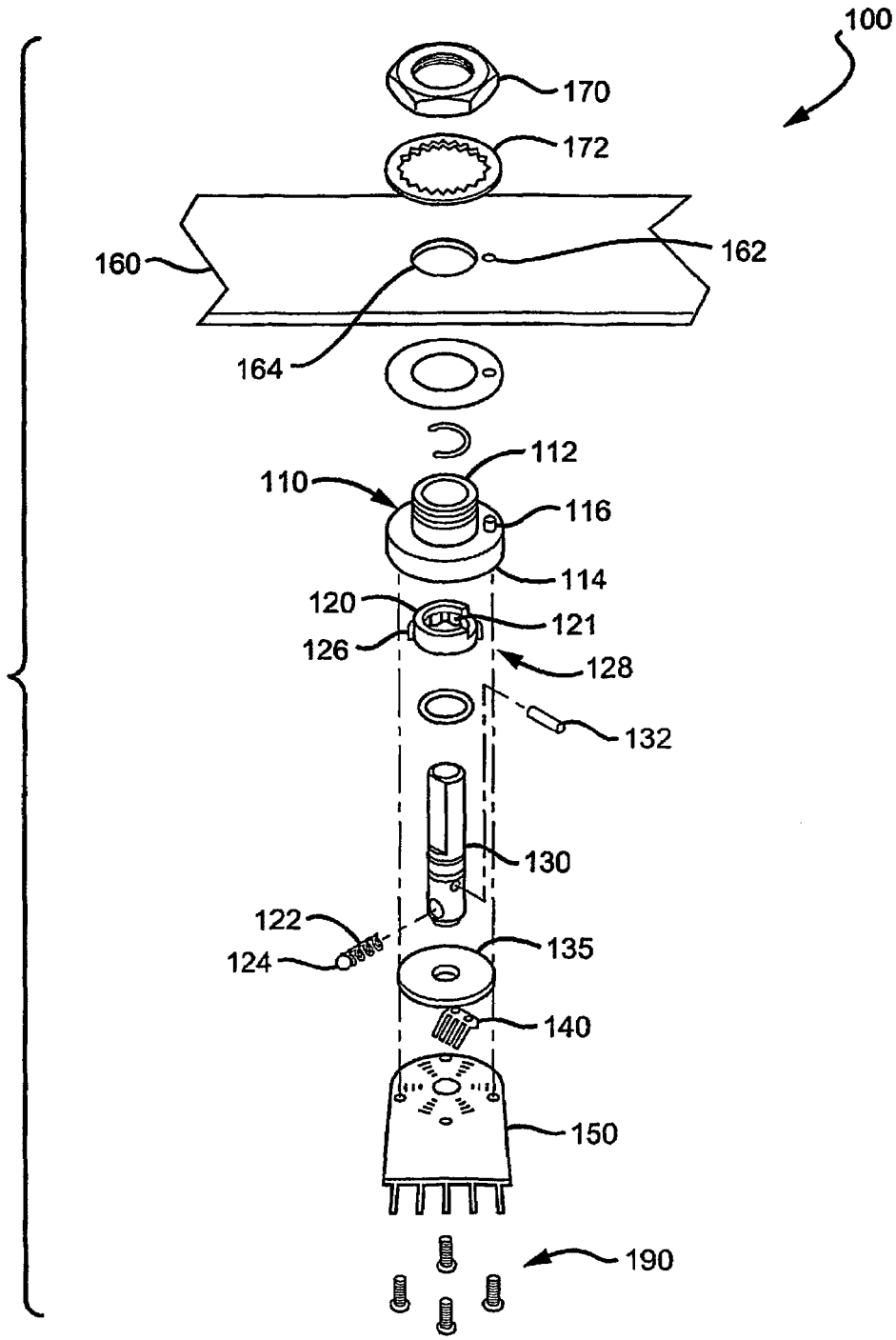
FIG. 1 is a perspective view of an exploded rotary switch.

FIG. 1 depicts a rotary switch 100 generally comprised of a bushing 110, a detent mechanism 120, a shaft 130, an electrical contact 140, and a printed circuit board (PCB) 150.

Bushing 110 is comprised of a threaded upper portion 112 and a lower portion 114. As defined herein, a bushing is a component of a switch that is used to hold the switch to a panel (e.g. a control borad) through which the switch is mounted. A preferred bushing has an upper portion that extends through a hole in the panel and a lower portion that contacts the underside (i.e. non-user side) of the panel. In FIG. 1, bushing 110 has a threaded upper portion 112 that extends through hole 164 in the panel 160. In order to facilitate holding of the switch to the panel, the lower portion 114 is of a diameter and/or shape that will not fit through the hole 164 in the panel 160. A lock washer 172 is placed over the upper portion of the bushing 112 and the capture nut 170 is threaded to the upper portion 112 in order to hold the switch to the panel. It is not required that a bushing be threaded and that a nut be used to hold the switch to the panel as non-threaded bushings may also be used. A non-threaded bushing can be held to the panel in other ways, for example by using rivets or compression fittings.

It is generally contemplated that a bushing should not rotate, and herein there are provided means for substantially prohibiting such rotational movement. One such means is a pin/aperture configuration in which the pin 116 fits snugly within an aperture 162 in the panel. In another class of embodiments, it may be advantageous to have a "D" shaped hole (opening) in the panel, such "D" shaped hole cooperating with a flat sided bushing to prevent rotation. It should be understood that any combination of suitable shapes and sizes will suffice so long as the combination substantially prohibits rotational movement. For example, the hole in the panel and the associated upper portion of the bushing may have two or more flat sides.

A detent sub-assembly is comprised of the detent mechanism 120 having rotors 121, a spring 122, and a ball 124. Further analysis of the switch depicted in FIG. 1 reveals a single spring detent sub-assembly in which the spring 122 is horizontally disposed (i.e perpendicular to the shaft). The spring is in contact (direct or indirect) with at least one ball 124. Note that in some horizontal single spring embodiments two balls may be utilized, one on each end of the spring. In any case, the ball 124 is biased toward the inner surface of the detent mechanism 120. Along the inner surface of the detent mechanism are rotor cams (i.e. cylindrical lobes) 121. As the shaft 130 of the switch is rotated, the ball(s) rotates about the rotor cams as the electrical contact 140 rotates about the PCB 150. The detent sub-assembly is housed within the bushing 110, preferably within the upper portion of the bushing 112. However, it is envisaged that a portion of the detent sub-assembly may extend into the lower portion of the bushing.

It is preferred that the detent mechanism be prevented from rotation within the bushing. Along these lines, the detent mechanism 120 can have an extrusion 126 that engages a notch 118 on the inner surface of the bushing thereby preventing such rotation. Of course, the shaft is intended to rotate, however, it can be advantageous to limit the rotation of the shaft. Limiting rotation of the shaft can be accomplished by using a pin 132 to limit the degree of rotation as a function of the size of a notch 128 in the detent mechanism. By limiting the rotation of the shaft, the available switch settings can be limited.

An electrical contact 140 (e.g. switch wipers or brushes) is mounted on a non-conductive disc 135 (i.e. dielectric) and the contact 140 cooperates with the circuit configuration on the PCB 150. The PCB 150 is anchored to the bushing 110 by metal rivets 190 or other connectors, however it should be noted that anchoring of the PCB to the bushing is not a requirement. Although not depicted, a PCB can contain additional electronic components (e.g chips, pins, leads, and so forth) that may interface with components other than the switch. Setting of a switch position, therefore, is generally a function of the interaction among the detent sub-assembly, the shaft, the electrical contact and the PCB.

Figure 2:
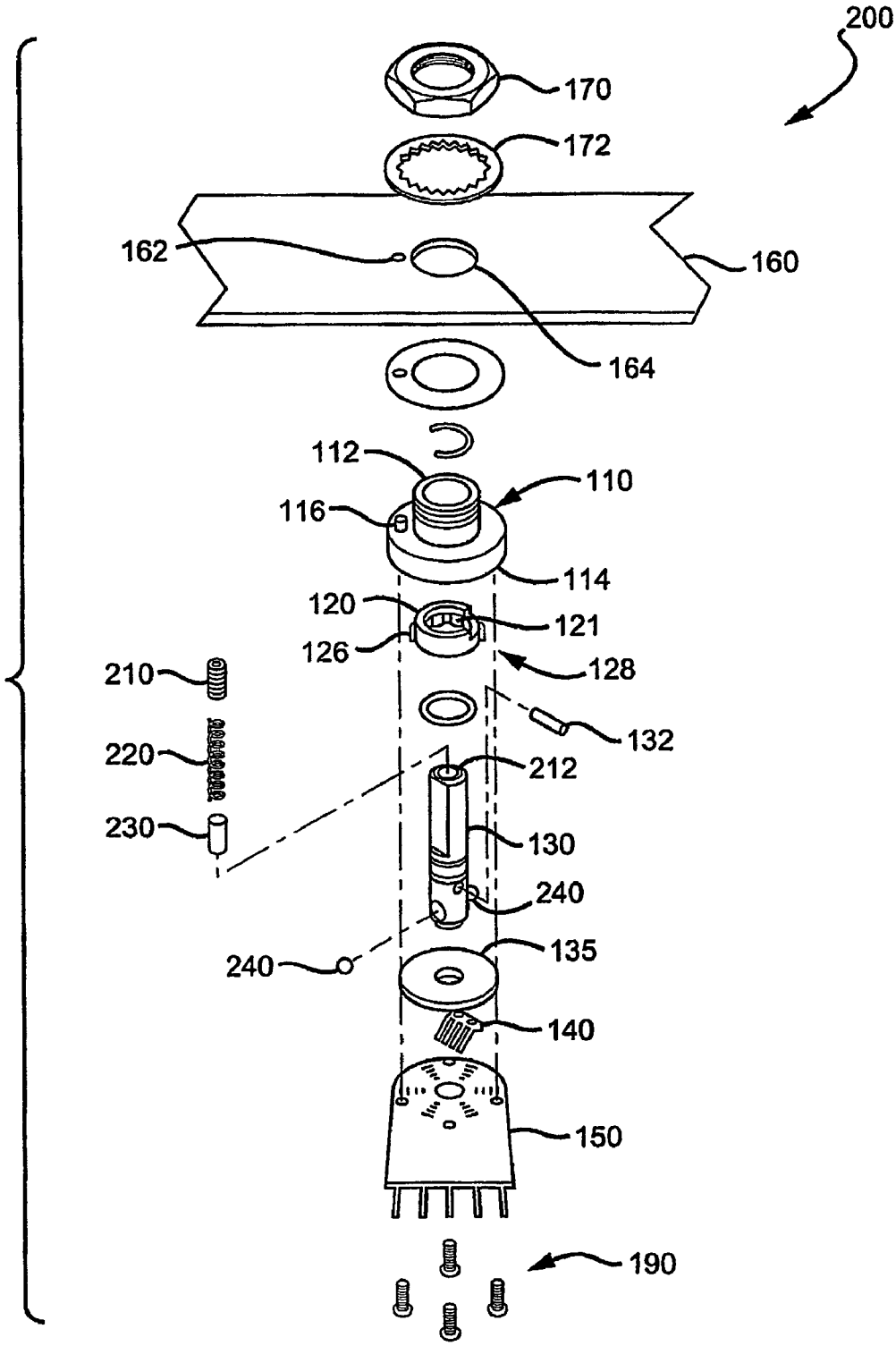
FIG. 2 is a perspective view of an exploded rotary switch.

Turning now to FIG. 2, an alternative embodiment includes a vertical spring 220 (i.e. parallel to the shaft), a set screw 210, and a plunger 230. The single vertical spring 220 is housed within the shaft and is elongated in the same direction as the shaft. The set screw 210 is threaded into the upper portion 212 of the shaft 130 thereby causing the plunger to exert outward pressure on the balls 240. The outward pressure biases the balls in the direction of the rotor cams on the inner surface of the detent mechanism 120. It should be noted that outward tension against the balls can be adjusted by threading or unthreading the set screw. As the set screw is threaded in, the plunger is forced downward (toward the PCB) and the balls are pushed outward. Of course, unthreading the set screw will have the opposite effect. A plunger is preferably cylindrical in shape and pointed. The preferred plunger not only provides uniform pressure to the balls, but it also allows for more than two balls to be used with a single spring.

Figure 3:
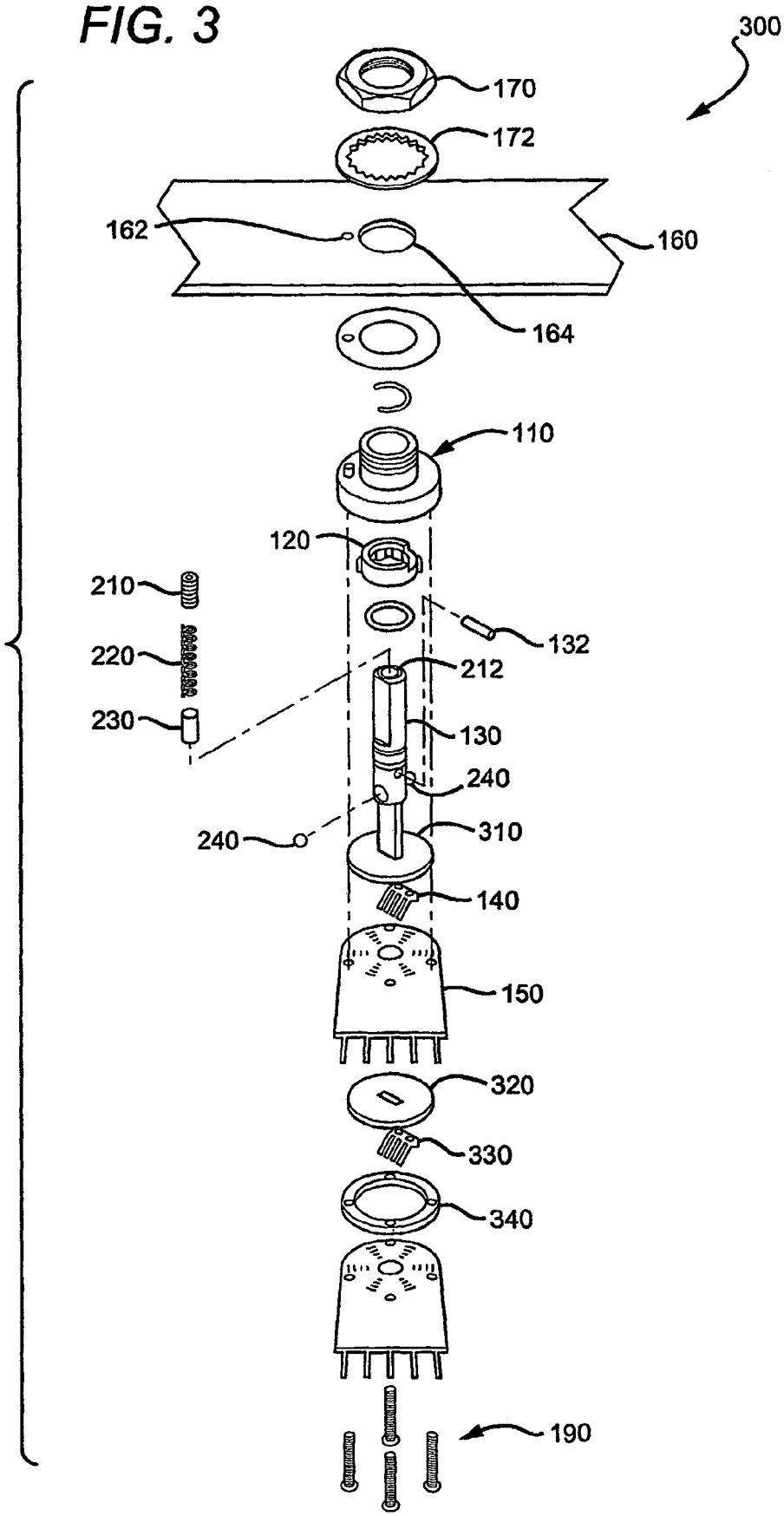
FIG. 3 is a perspective view of an exploded rotary switch.

A switch can be configured to set a plurality of electrical settings. FIG. 3 depicts a multiple deck switch having a vertical spring configuration. The embodiment of FIG. 3 has two sets of contacts and two PCBs. The first set of contacts 140 is attached to a non-conductive (dielectric) disc 310 which is further coupled to the shaft 130. A second non-conductive disc 320 is also coupled to the shaft 130 and is further coupled to a second set of contacts 330. A spacer 340 provides insulation between the PCBs.

Functionally, the shaft of a switch is generally rotated by manual movement in order to set a switch position. Switch positions are defined by the rotor cams (lobes) in the detent mechanism. Upon rotation of the shaft, a ball protruding from the shaft will set in the area between two rotor cams thereby defining a switch position. A user of the switch will be able to feel the ball set between the rotor cams. As a ball rotates about the inner surface of the detent mechanism, the contacts form electrical connections based on the relationship between the contact and the PCB. While the switches enumerated here are shown with a stop pin to limit the rotation of the shaft, this is not a requirement as some switches will allow 360 degree rotation in both directions.

Methods of use include mounting a rotary switch such that the detent sub-assembly is in planar relation to a panel. Since most of the upper portion of the bushing is on the user's side of the panel, however, the detent sub-assembly may be substantially on the user's side of the panel rather than in a plane with the panel. Additionally, there may even be a portion of the detent sub-assembly which extends underside of the panel. Thus, a single detent sub-assembly may be positioned such that a portion of the detent sub-assembly is above the panel, a portion is parallel with the panel, and a portion is below the panel.

Thus, specific embodiments and applications of a low profile switch with a detent in the bushing have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A panel mounted rotary switch, comprising:

a bushing having an upper portion that extends through the panel to a user's side and a lower portion that remains beneath the panel and prevents the bushing from movement toward the user's side; and a detent sub-assembly housed in the upper portion of the bushing.

2. The panel mounted rotary switch of claim 1, having a shaft that couples a knob on the user's side with an electrical contact beneath the panel.

3. The panel mounted rotary switch of claim 2, wherein operation of the detent sub-assembly is independent of the knob.

4. The panel mounted rotary switch of claim 1, wherein the detent sub-assembly is positioned an planar relation to the panel.

5. The panel mounted rotary switch of claim 1, wherein the bushing is prevented from rotational movement by an engagement with the panel.

6. The panel mounted rotary switch of claim 5, wherein the lower portion of the bushing has a stop pin that fits within an aperture on the panel.

7. The panel mounted rotary switch of claim 6, wherein the detent sub-assembly is prevented from rotational movement by an engagement with the bushing.

8. The panel mounted rotary switch of claim 7, wherein the engagement with the bushing comprises an extrusion on the detent sub-assembly that cooperates with a groove on the bushing.

9. The panel mounted rotary switch of claim 5, wherein the upper portion of the bushing has a flat side that cooperates with a D shaped opening in the panel to prevent rotational movement.

10. The panel mounted rotary switch of claim 1, wherein the detent sub-assembly utilizes only one spring and at least one ball to contact rotor cams (cylindrical lobes) thereby setting a switch position.

11. The panel mounted rotary switch of claim 1 in electrical connection to a plurality of printed circuit boards.

12. A method of using a rotary switch, comprising:

mounting the rotary switch to a panel such that a detent sub-assembly is in planar relation to the panel.

13. The method of claim 12, wherein the detent sub-assembly is housed in a bushing that extends from beneath the panel to above the panel.

14. A rotary switch having a detent sub-assembly housed in an upper portion of a bushing, a shaft that couples a user-rotatable knob on a upper portion of the shaft, wherein the knob is capable of being rotated directly by a user without linear movement of the shaft, and wherein a rotational movement of the shaft makes an electrical connection between a first terminal and a second terminal.

* * * * *